US005970578A

United States Patent [19]

Mensching et al.

[11] Patent Number: 5,970,578

[45] Date of Patent: Oct. 26, 1999

[54] THEATRICAL SCENERY CARRIAGE AND MOVEMENT MECHANISM

[75] Inventors: William M. Mensching, New Canaan; Tien Tsung Ma, Norwalk, both of Conn.

[73] Assignee: Show Motion, Inc., South Norwalk, Conn.

[21] Appl. No.: 09/035,743

[22] Filed: Mar. 6, 1998

[51] Int. Cl.[6] ..... A47H 1/04; A47H 15/00

[52] U.S. Cl. ..... 16/94 R; 16/96 D; 16/106

[58] Field of Search ..... 16/91, 93 R, 93 D, 16/94 R, 94 D, 96 R, 96 D, 106, 107, 87 R, 87 B, 97, 98; 49/409, 410; 160/197, 198, 202

[56] References Cited

U.S. PATENT DOCUMENTS

| | | | |
|---|---|---|---|
| 926,778 | 7/1909 | Stuyverson | 16/106 |
| 1,073,509 | 9/1913 | Nelson | 16/106 |
| 2,633,088 | 3/1953 | King | 16/106 |
| 3,049,083 | 8/1962 | Potter et al. | 16/91 |
| 3,425,162 | 2/1969 | Halpern | 16/91 |
| 3,438,599 | 4/1969 | Welzen | 16/91 |
| 4,073,034 | 2/1978 | Martens | 16/87 |
| 4,281,435 | 8/1981 | Winter et al. | 16/94 R |
| 4,698,876 | 10/1987 | Karita | 16/102 |
| 5,542,149 | 8/1996 | Yu | 16/87 |

*Primary Examiner*—Chuck Y. Mah

*Attorney, Agent, or Firm*—St. Onge Steward Johnston & Reens LLC

[57] ABSTRACT

An apparatus for supporting one or more theatrical panels and, in a more specific aspect, a carriage assembly adapted for such task in association with a horizontal track having an upper guide surface and a lower guide surface, provide horizontal movement quietly, smoothly, with low frictional resistance and in a highly-linear fashion with low rock and sway. A horizontal track comprising an upper guide surface and a lower guide surface supports a carriage assembly having a plurality of upper guide wheels and a plurality of lower guide wheels. The upper guide wheels are supported in rolling contact with the upper guide surface and the lower guide wheels are supported in rolling contact with the lower guide surface. The axles supporting the upper guide wheels are preferably horizontally offset from vertical lines extending through any of the axles supporting the lower guide wheels. The guide wheels are preferably resilient at least at the surface and grooved to engage the guide surfaces.

18 Claims, 3 Drawing Sheets

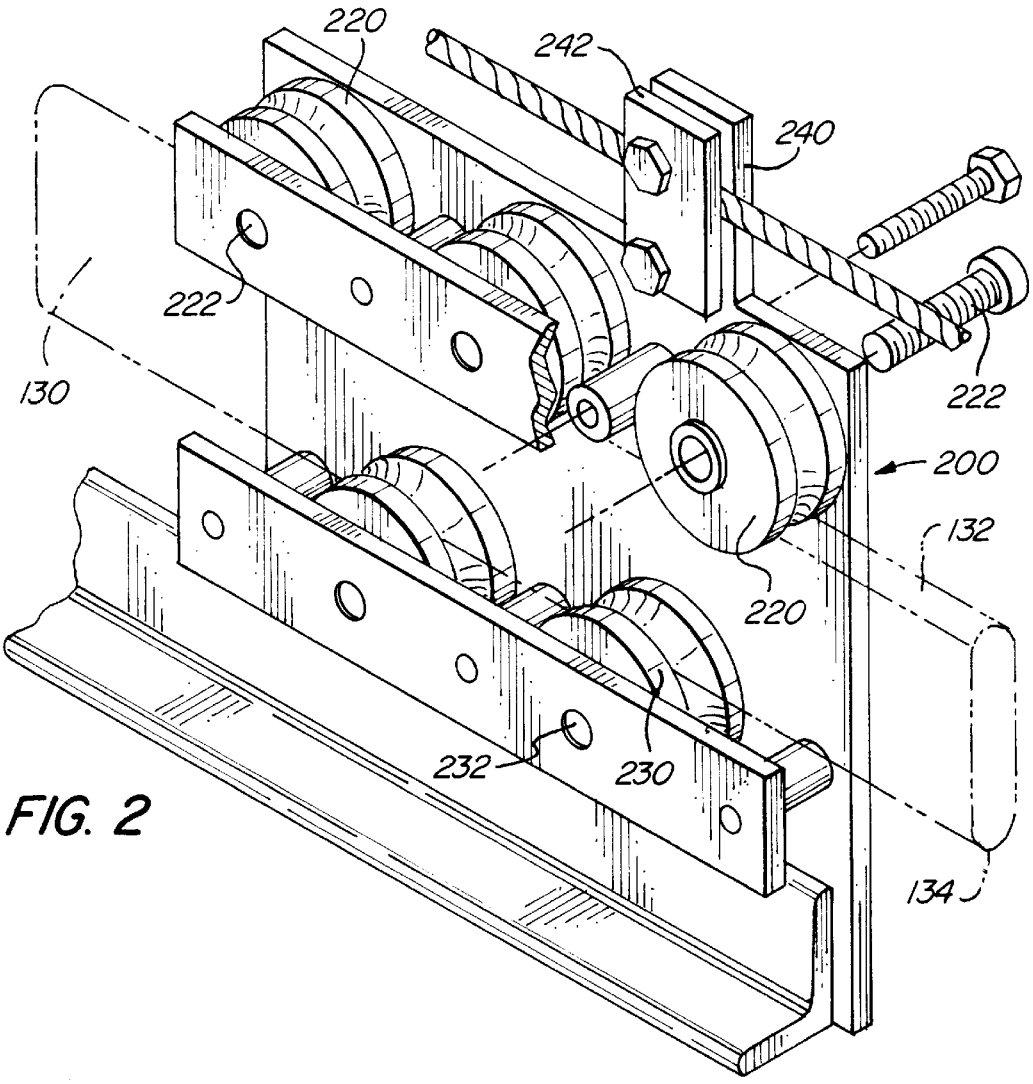
FIG. 2
FIG. 3
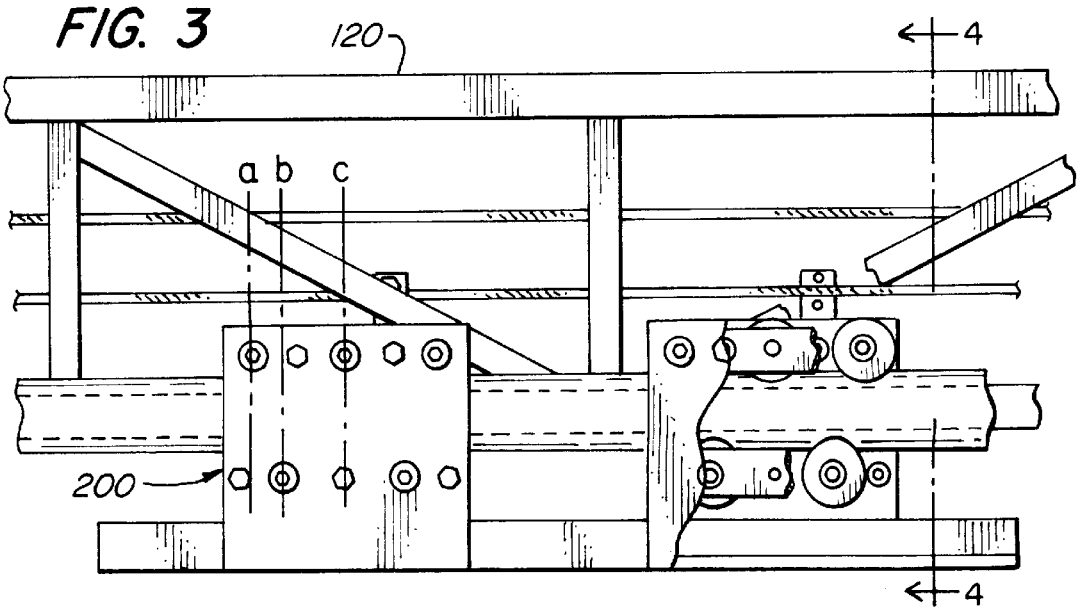

THEATRICAL SCENERY CARRIAGE AND MOVEMENT MECHANISM

TECHNICAL FIELD

The invention relates to a mechanism for transporting theatrical scenery between several service and out-of-service positions quietly, smoothly, and with low frictional losses.

To a large extent, the success of a theatrical production will depend on the ability of a stage crew to visually, but seamlessly, move the action from one virtual location to another - preferably, without the audience being aware of the transition, other than a darkening of the stage.

Some scenery devices consist of objects that can be placed at designated places on a stage and moved about by either stage crews or cables having associated pulleys and dogs running through open slots in the stage. Others, the concern of this invention, comprise large, flat panels which are extended from support structures located high above the stage and largely out of sight of the audience. Panels of this type are typically employed to provide scenic backdrops and are moved into and out of position by what are essentially large curtain rods, Scenery panels vary greatly in materials of construction and weight. With currently-available apparatus for supporting scenery panels and facilitating their horizontal movement, the weight of the panel and the intended speed of transition can cause abrupt and irregular movements—sure to catch the eye of and distract the theater goer. Moreover, currently-available apparatus is often less quiet than desired and is more subject to the adverse effects of friction. Indeed, rock and sway of large panels frequently occurs—a result undesirable in itself—and can exaggerate frictional problems.

There is a current need for an apparatus for supporting scenery panels and facilitating their horizontal movement quietly, smoothly, with low frictional resistance, and in a highly-linear fashion with low rock and sway.

BACKGROUND ART

A number of devices have been used in the art to facilitate the horizontal movement of scenery panels for staged productions of various types. Typically, they have taken forms similar to drapery rods.

Among related devices are a carriage and rail assembly for a curtain described in U.S. Pat. No. 5,542,149 to Yu. Figures 6 and 7 of that patent set forth a prior art device which includes twin horizontal tracks for guiding a carriage suspended on axles connecting pairs of wheels riding in the tracks, with the curtain suspended between the tracks. Various stresses on the carriage during movement of a supported curtain, can cause uneven loading and upward and sideward biasing of the wheels. This subjects the wheels to damage, breaking and difficult movement. To improve on this structure, pairs of displacement-limiting rollers are added to oppose upward and sideward displacement from the tracks. While an apparent improvement on the prior art, this arrangement requires a total of ten wheels per carriage for carrying a single curtain. It would be desirable to reduce the complexity of such a carriage and rail assembly and yet provide the capability to hold and convey a plurality of curtains or scenery panels.

In U.S. Pat. No. 4,073,034, Martens describes a system for supporting and moving panels of a multi-panel door which also includes upper and lower rollers to maintain alignment on a track. Two door panels are shown supported on the same track and move in coordinated fashion, with one moving at twice the speed of the other. There is no provision made for two parallel tracks for independently moving two individual panels or for supporting panels on two sides to provide greater stability against sway transverse to the direction of movement and resulting torsional dislodgment in situations where that might be a problem. In addition, the device described cannot provide good stability against rocking in the direction of movement unless a multiplicity of hangers are provided for each panel. It would be desirable to have a carriage assembly having greater stability and versatility.

In U.S. Pat. No. 4,698,876, Karita shows a variation on the Martens-type of arrangement, but enables a magnetic force to support at least a part of the weight of the door. The improvements described in the patent do not, however, adapt it to the needs addressed by the present invention.

The above and other drapery and panel door hangers are available, but the art of supporting and moving theatrical scenery panels is awaiting the development of an apparatus for supporting such panels and facilitating their horizontal movement quietly, smoothly, with low frictional resistance and in a highly-linear fashion with low rock and sway.

DISCLOSURE OF INVENTION

It is an object of the invention to provide an improved apparatus for supporting and moving theatrical scenery panels.

It is another object of the invention to reduce or eliminate rock and sway when supporting and moving theatrical scenery panels.

It is another object of the invention to enable supporting and moving theatrical scenery panels quietly, smoothly, with low frictional resistance and in a highly-linear fashion with reduced rock and sway.

It is another object of the invention to improve the ability to stage a theatrical production by providing improved apparatus for supporting and moving theatrical scenery panels.

These and other objects are achieved by the present invention which provides an apparatus for supporting one or more panels to facilitate horizontal movement thereof and, in a more specific aspect, a carriage assembly adapted for such task in association with a horizontal track having an upper guide surface and a lower guide surface.

The apparatus according to the invention for supporting one or more panels to facilitate horizontal movement thereof, comprises: a horizontal track comprising an upper guide surface and a lower guide surface; and a carriage assembly supported on said track, said carriage assembly comprising a carriage body which supports a plurality of upper guide wheels and a plurality of lower guide wheels; wherein said upper guide wheels are supported in rolling contact with said upper guide surface and said lower guide wheels are supported in rolling contact with said lower guide surface.

A carriage assembly adapted for association with a horizontal track having an upper guide surface and a lower guide surface, comprises: a carriage body including a vertically-oriented plate having an upper portion including a connector for translational force transmitting means, a middle portion supporting horizontal axles for upper guide wheels and lower guide wheels, and a lower portion including means for supporting a panel; upper guide wheels supported by associated axles and in rolling contact with said upper guide surface; and lower guide wheels supported by associated axles and in rolling contact with said lower guide surface; wherein the axles supporting the upper guide wheels are horizontally offset from vertical lines extending through any of the axles supporting the lower guide wheels.

BRIEF DESCRIPTION OF THE DRAWINGS

The invention will be better understood and its advantages more apparent from the following detailed description, especially when read in light of the accompanying drawings, wherein:

FIG. 2 is a perspective view in greater than FIG. 1 of one apparatus for supporting one or more panels to facilitate horizontal movement thereof, according to the invention;

FIG. 3 is a front elevation of the apparatus shown in FIG. 2, showing also a preferred form of support structure;

DETAILED DESCRIPTION OF A PREFERRED EMBODIMENT

Figure 1:
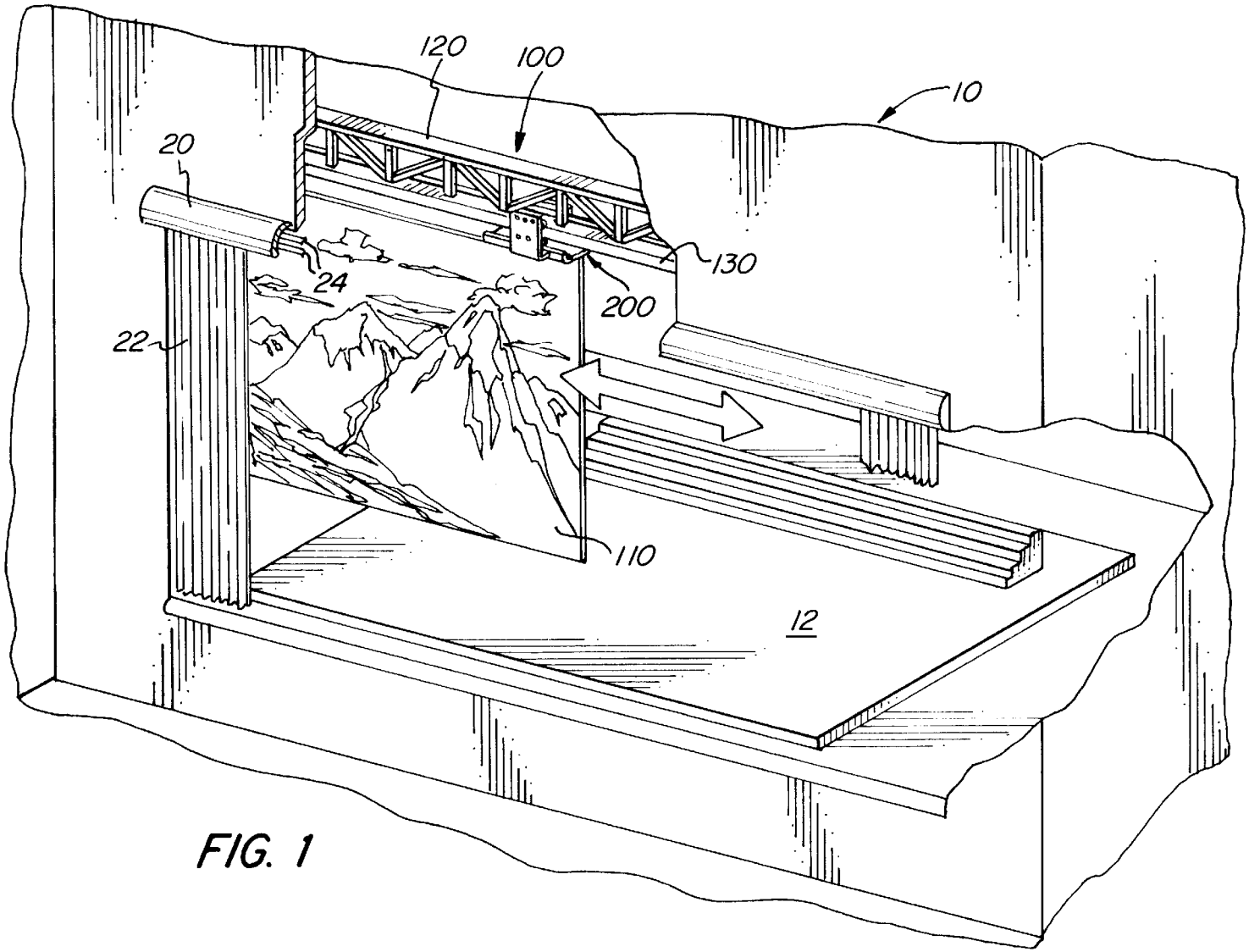
FIG. 1 is a perspective view showing a stage and of one embodiment of a theatrical scenery carriage and movement mechanism of the inventions

Reference is made to FIG. 1 which shows, in perspective, a stage 10 and of one embodiment of a theatrical scenery carriage and movement mechanism of the invention 100 supporting a scenery panel 110. Panels of this type can have whatever construction is practical under the circumstances—simply wooden frames with painted cloth, paper, board or the like. Or, they can be complex structures involving woodwork or metalwork integrated with and extending from a more simple panel structure. It is an advantage of the invention that panels including complex and heavy structures can be supported and moved more easily than when utilizing apparatus provided by the prior art.

While important to the invention only for context, a stage surface 12 is shown to have a curtain carrier 20 capable of moving curtains 22 by means of ropes 24 in the usual manner. A theatrical scenery carriage and movement mechanism apparatus of the invention 100 is shown to include a support structure 120 carrying a horizontal track 130 and a carriage assembly 200 for movement of scenery panel 110 in the directions indicated by the two-headed arrow. Panel 110 is shown as being of substantial width, requiring two carriage assemblies as a matter of practicality; however, it is an advantage of the invention that many panels can be supported and moved by a single such assembly. Many of the obvious details of construction, although shown in the drawings will not be described herein in detail because the person skilled in the art will know how to assemble the main structural parts from the description and the drawings given using conventional assembly techniques and construction materials.

Figure 4:
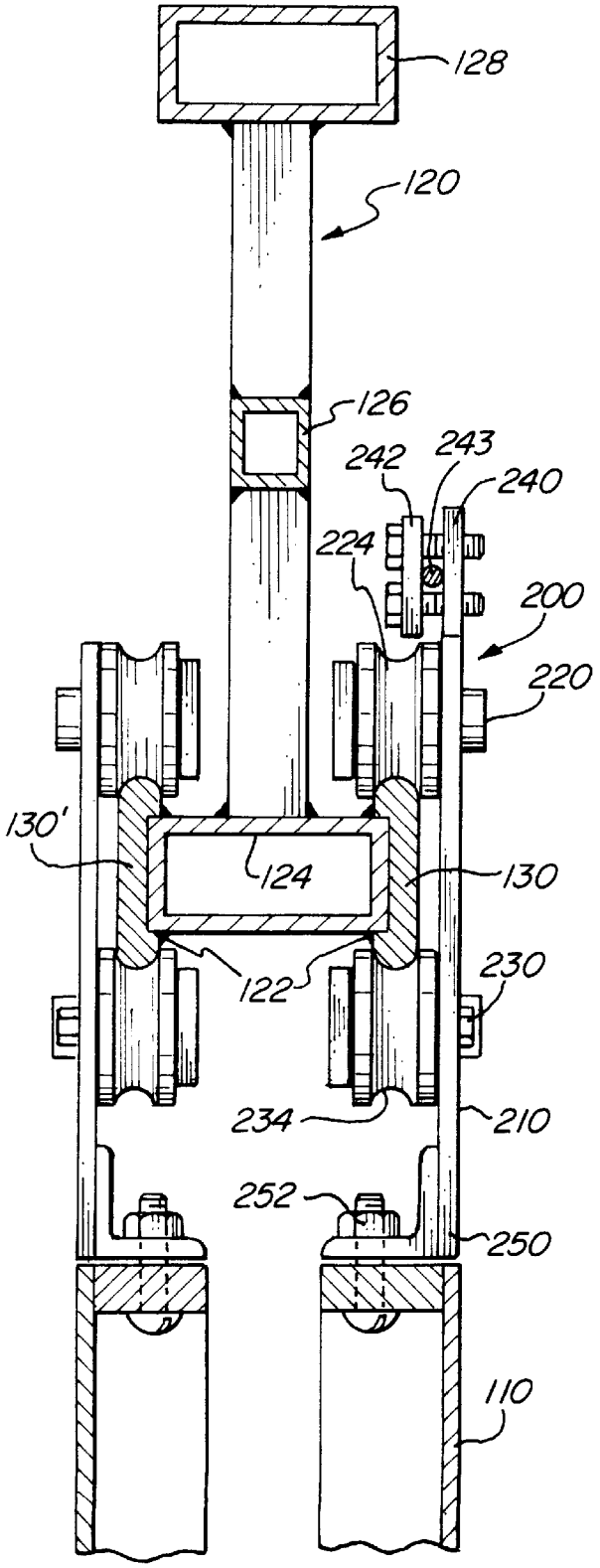
FIG. 4 is a cross-sect ion taken along line 4—4 in FIG. 3.
Figure 5:
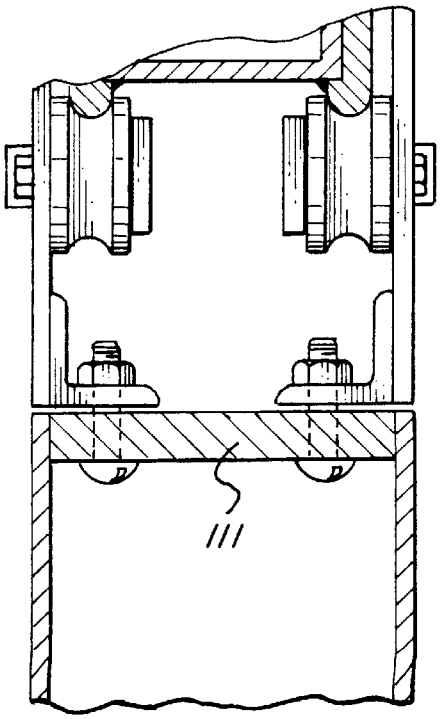
FIG. 5 is a view similar to FIG. 4, but partially broken away, showing an embodiment with a single panel support.

FIG. 2 shows, in perspective, a more detailed view of a carriage assembly 200 and its operational engagement with a support structure 120 including horizontal track 130. As illustrated, track 130 comprises an elongated guide bar having an upper guide surface 132 and a lower guide surface 134. Reference to FIG. 4 shows that the guide bar can be attached to the support structure 120 by welding (e.g., see welding beads 122). If desired, the attachment can be made by means of bolts, keyed fittings or otherwise as may be practical under the circumstances. The support structure can be constructed, for example of aluminum tubing, such as indicated in cross section at 124, 126 and 128 in FIG. 4. It will be noticed that FIG. 4 shows a pair of horizontal tracks (130 and 130') positioned parallel to each other on opposed sides of the support structure 120. Because it is preferred that the structures on either side of the support structure be like those on the other, this description will detail only the one on the right side of the drawing in FIG. 4. FIG. 5 is a view similar to FIG. 4, but partially broken away, showing an embodiment with a single panel support 111.

A preferred form of carriage assembly according to the invention is shown as 200 in FIGS. 2 to 4. The carriage assembly is adapted for association with a horizontal track, such as 130, having an upper guide surface 132 and a lower guide surface 134. The carriage assembly is comprised of three main components: a carriage body 210, a set of upper guide wheels 220, and a set of lower guide wheels 230.

The carriage body is shown to include a vertically-oriented plate (typically of steel or other structural material) having an upper portion 240 including a connector 242 for transmitting translational force by suitable means such as provided by cable, rope or wire 243. The carriage body is also shown to include a middle portion supporting horizontal axles 222 for upper guide wheels 220 and horizontal axles 232 for lower guide wheels 230. The carriage body is additionally shown to include a lower portion 250 including means 252 for supporting a panel 110.

The figures show upper guide wheels 220 to be supported by associated axles 222 and in rolling contact with the upper guide surface 132. The lower guide wheels 230 are, likewise shown to be supported by associated axles, in this case 232. The lower guide wheels are shown in rolling contact with said lower guide surface 134. In the preferred arrangement as shown, the axles 122 supporting the upper guide wheels are horizontally offset from vertical lines extending through any of the axles supporting the lower guide wheels. For example, see FIG. 3 and the distances between line b which goes through a lower guide wheel axles and lines a and c which each go through upper guide wheel axles. The upper and lower axles can be bolts of suitable dimension or rods having a threaded end. Alternative axle structures can be employed as practical.

The guide wheels will preferably be comprised of a resilient periphery having a groove therein (e.g., 224 for the upper wheels and 234 for the lower wheels), said groove being at least as wide in axial extent as the thickness of the upper or lower guide surface in contact therewith. The wheels can employ suitable bearings to facilitate rotation about the respective axles.

In operation, a panel is supported by one or more of the carriages and is easily moved along an intended horizontal path by means of cable 243 or the like. Operation is smooth and easily controlled.

The above description is for the purpose of teaching the person of ordinary skill in the art how to practice the present invention, and it is not intended to detail all of those obvious modifications and variations of it which will become apparent to the skilled worker upon reading this description. It is intended, however, that all such obvious modifications and variations be included within the scope of the present invention which is defined by the following claims. The claims cover the indicated components and steps in all arrangements and sequences which are effective to meet the objectives intended for the invention, unless the context specifically indicates the contrary.

We claim:

1. An apparatus for supporting one or more panels to facilitate horizontal movement thereof, comprising:

at least one horizontal track comprising an upper guide surface and a lower guide surface; and at least one carriage assembly supported on said track, said carriage assembly comprising a carriage body which supports a plurality of upper guide wheels and a plurality of lower guide wheels;

wherein said upper guide wheels are supported in rolling contact with said upper guide surface and said lower guide wheels are supported in rolling contact with said lower guide surface, and wherein on at least one of said individual carriage assemblies, the number of upper guide wheels differs from the number of lower guide wheels by one, each of the upper guide wheels and the lower guide wheels are rotatably supported on said carriage body by horizontally-extending axles, and the axles supporting the upper guide wheels are horizontally offset from vertical lines extending through any of the axles supporting the lower guide wheels.

2. An apparatus according to claim 1 wherein:

said upper guide surface and said lower guide surface comprise opposed edges of an elongated guide bar affixed to a support structure.

3. An apparatus according to claim 2 wherein said at least one horizontal track includes:

a pair of horizontal tracks comprised of elongated guide bars positioned parallel to each other on opposed sides of said support structure, each horizontal track having an upper guide surface and a lower guide surface.

4. An apparatus according to claim 3 wherein said at least one horizontal track includes:

a pair of carriage assemblies, one supported on a first horizontal track and one supported on the horizontal track positioned on the side of said support structure opposite the first horizontal track.

5. An apparatus according to claim 1 wherein:

each said at least one carriage assembly includes three upper guide wheels and two lower guide wheels, with the upper guide wheels being equally spaced one from the other and the lower guide wheels are positioned along vertical lines which bisect lines connecting the centers of the axles supporting the upper guide wheels.

6. An apparatus according to claim 1 wherein:

each of the guide wheels comprises a resilient periphery having a groove therein, said groove being at least as wide in axial extent as the thickness of the upper or lower guide surface in contact therewith.

7. An apparatus for supporting one or more panels to facilitate horizontal movement thereof, comprising:

at least one horizontal track comprising an upper guide surface and a lower guide surface; and at least one carriage assembly supported on said track, said carriage assembly comprising a carriage body which supports a plurality of upper guide wheels and a plurality of lower guide wheels; wherein said upper guide wheels are supported in rolling contact with said upper guide surface and said lower guide wheels are supported in rolling contact with said lower guide surface, where, on at least one of said carriage assemblies: the number of upper guide wheels differs from the number of lower guide wheels by one, each of the upper guide wheels and the lower guide wheels are rotatably supported on said carriage body by horizontally-extending axles, and the axles supporting the upper guide wheels are horizontally offset from vertical lines extending through any of the axles supporting the lower guide wheels, and wherein said carriage body comprises a vertically-oriented plate which includes an upper portion including a connector for translational force transmitting means, a middle portion supporting horizontal axles for said upper guide wheels and said lower guide wheels and a lower portion including means for supporting a panel.

8. An apparatus according to claim 7 wherein:

said upper guide surface and said lower guide surface of said at least one horizontal track comprise opposed edges of an elongated guide bar affixed to a support structure; and said at least one carriage assembly comprises a pair of carriage assemblies, one supported on a first horizontal track on one side of a support structure and one supported on a horizontal track positioned on a side of said support structure opposite the first horizontal track.

9. An apparatus according to claim 8 wherein:

each carriage assembly includes three upper guide wheels and two lower guide wheels, with the upper guide wheels being equally spaced one from the other and the lower guide wheels are positioned along vertical lines positioned between connecting the centers of the axles supporting the upper guide wheels.

10. An apparatus according to claim 8 wherein:

each of the guide wheels comprises a resilient periphery having a groove therein, said groove being at least as wide in axial extent as the thickness of the upper or lower guide surface in contact therewith.

11. An apparatus according to claim 8 wherein:

said horizontal axles extend from the middle portions of each carriage body toward an associated horizontal track and the support structure such that the upper guide wheels and the lower guide wheels are positioned in rolling contact with the associated horizontal track.

12. An apparatus for supporting at least two panels to facilitate independent horizontal movement thereof, comprising:

a pair of horizontal tracks, each comprising an elongated guide bar affixed to a support structure and each including an upper guide surface and a lower guide surface; and at least two carriage assemblies, with at least one supported on each of said tracks, said carriage assemblies comprising a carriage body which comprises a vertically-oriented plate which includes an upper portion including a connector for translational force transmitting means, a middle portion supporting horizontal axles for upper guide wheels and lower guide wheels, and a lower portion including means for supporting a panel;

upper guide wheels supported by associated axles and in rolling contact with said upper guide surface; and lower guide wheels supported by associated axles and in rolling contact with said lower guide surface.

13. An apparatus according to claim 12 wherein:

the number of upper guide wheels on each carriage assembly differs from the number of lower guide wheels by one, each of the upper guide wheels and the lower guide wheels are rotatably supported on said carriage body by horizontally-extending axles, and the axles supporting the upper guide wheels are horizontally offset from vertical lines extending through any of the axles supporting the lower guide wheels.

14. An apparatus according to claim 13 wherein:

each carriage assembly includes three upper guide wheels and two lower guide wheels, with the upper guide wheels being equally spaced one from the other and the lower guide wheels are positioned along vertical lines which are positioned between lines connecting the centers of the axles supporting the upper guide wheels.

15. An apparatus according to claim 12 wherein:

each of the guide wheels comprises a resilient periphery having a groove therein, said groove being at least as wide in axial extent as the thickness of the upper or lower guide surface in contact therewith.

16. A carriage assembly adapted for association with a horizontal track having an upper guide surface and a lower guide surface, said carriage comprising:

a carriage body including a vertically-oriented plate having an upper portion including a connector for translational force transmitting means, a middle portion supporting horizontal axles for upper guide wheels and lower guide wheels, and a lower portion including means for supporting a panel;

upper guide wheels supported by associated axles and configured for rolling contact with said upper guide surface; and lower guide wheels supported by associated axles configured for rolling contact with said lower guide surface; wherein the axles supporting the upper guide wheels are horizontally offset from vertical lines extending through any of the axles supporting the lower guide wheels.

17. An apparatus according to claim 16 wherein: said carriage assembly includes three upper guide wheels and two lower guide wheels, with the upper guide wheels being equally spaced one from the other and the lower guide wheels are positioned along vertical lines which are positioned between lines connecting the centers of the axles supporting the upper guide wheels.

18. An apparatus according to claim 16 wherein:

each of the guide wheels comprises a resilient periphery having a groove therein, said groove being at least as wide in axial extent as the thickness of the upper or lower guide surface in contact therewith.

* * * * *